United States Patent [19]

Latham

[11] 4,057,868

[45] Nov. 15, 1977

[54] COLLAPSIBLE BRUSH

[76] Inventor: Roger D. Latham, 5213 W. 12th St., Sioux Falls, S. Dak. 57106

[21] Appl. No.: 757,242

[22] Filed: Jan. 6, 1977

[51] Int. Cl.[2] ..... A46B 9/10

[52] U.S. Cl. ..... 15/203

[58] Field of Search ..... 15/203; 132/11 R

[56] References Cited

U.S. PATENT DOCUMENTS 2,486,203 10/1949 Pieper ..... 15/203

3,947,914 4/1976 Jacoby ..... 15/203

*Primary Examiner*—Edward L. Roberts

*Attorney, Agent, or Firm*—Cushman, Darby & Cushman

[57] ABSTRACT

A brush frame is provided which supports a slidable handle and a plurality of rotatable bristle-carrying rods arranged with their longitudinal axes parallel to one another. The handle includes projections extending into curved grooves within the rods whereby when the handle is displaced relative to the frame, the rods are rotated about their axes to raise or lower the bristles.

14 Claims, 5 Drawing Figures

Fig. 1.
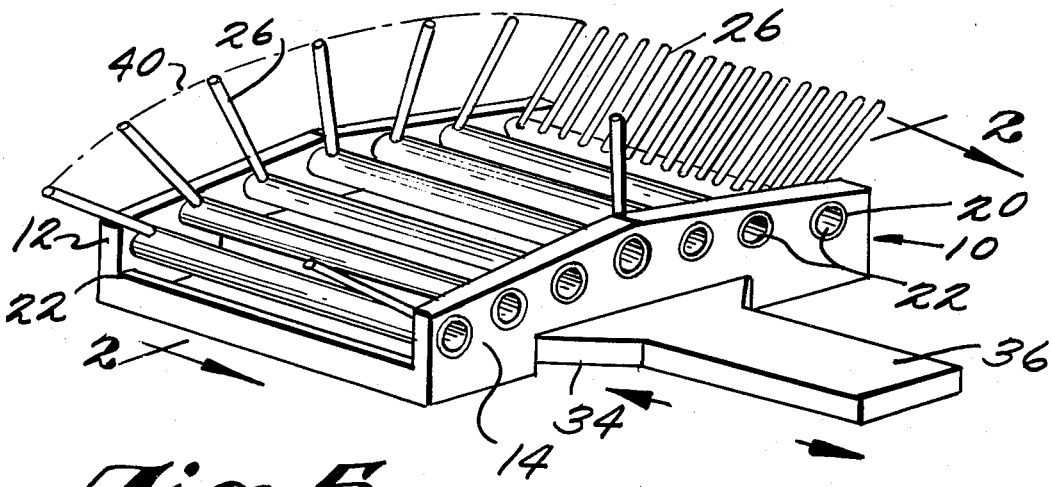
Fig. 5.
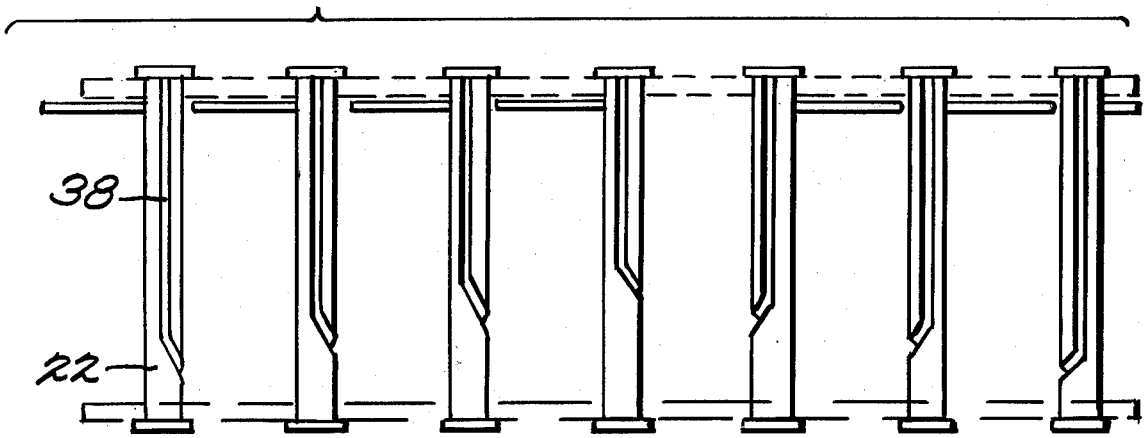
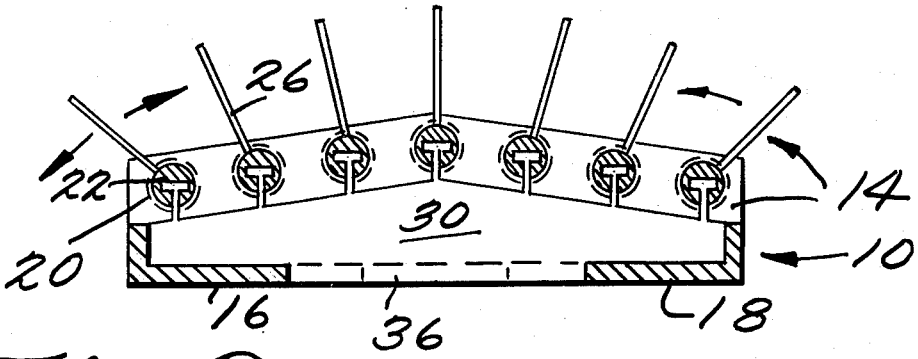
Fig. 2.

COLLAPSIBLE BRUSH

BACKGROUND OF THE INVENTION

The present invention relates to a collapsible hair brush construction which is compact, lightweight and portable.

A number of attempts have been made to develop collapsible brushes. However, such prior efforts have usually suffered important shortcomings which the present invention overcomes. A typical example of the prior art is U.S. Pat. No. 3,947,914 which issued on Apr. 6, 1976 to Albert Jacoby. The Jacoby patent discloses a compact hairbrush having a collapsible handle which, when extended, raises rows of bristles from collapsed overlying relationship to an erected state. This is accomplished by a type of rack and pinion arrangement which is expensive to produce and which is subject to wear and breakage. Additionally, the bristles are raised to substantially parallel planes which produce less than optimum effectiveness in the normal brushing of one's hair.

SUMMARY OF THE INVENTION

The present invention constitutes a substantial improvement over prior art devices by providing a simple, economical collapsible brush construction wherein, in a preferred embodiment of the invention, extension of a retractable handle causes the bristles to elevate to lie in non-parallel planes thereby permitting better management of the hair during the normal brushing stroke.

The foregoing is accomplished by joining the handle in operative relationship with a plurality of cylindrical rods which support the bristles. When the handle is actuated, the rods are rotated about their longitudinal axes by differing amounts, thereby displacing the bristles between their collapsed and erected states.

Details of this arrangement now will be described more fully in connection with the accompanying drawings wherein:

FIG. 1 is a perspective view of a preferred embodiment of the invention illustrating the bristles in a raised state;

FIG. 2 is a cross-sectional view taken along line 2—2 of FIG. 1;

FIG. 5 is a diagrammatic illustration of the relationship of several bristle-supporting rods configured according to the embodiment shown in FIG. 1.

Figure 3:
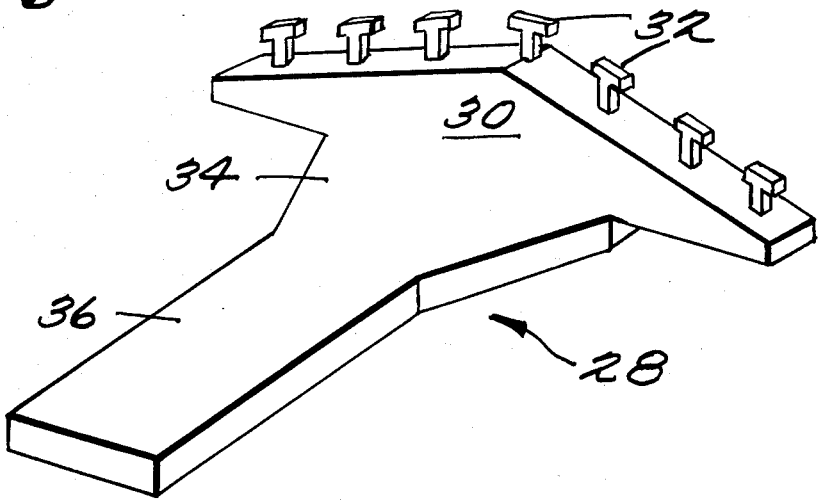
FIG. 3 is a perspective view of a handle suitable for use in the embodiment shown in FIG. 1.

Referring now to the drawings, FIGS. 1 and 2 illustrate a frame member 10 comprising a pair of walls 12 and 14 joined by spaced bottom portions 16 and 18. Preferably, frame 10 is a one-piece construction molded from a lightweight plastic material.

A plurality of apertures 20 are provided at corresponding locations in walls 12 and 14 in order to rotatably receive a plurality of cylindrical rods 22 having their longitudinal axes extending parallel to one another. Each of the rods supports a row of brush bristles 26.

A handle 28 (FIG. 3) comprises base member 30 supporting a plurality of T-shaped projections 32 which cooperate with rods 22 as hereinafter will be described.

The handle further includes a flared projecting portion 34 and a grip portion 36. Again, the handle preferably is a single piece construction of molded plastic.

The sections of handle base member 30 outwardly of flared portion 34 rest on bottom portions 16 and 18 of the frame, while the flared and grip portions 34 and 36 of the handle are positioned in the space between portions 16 and 18. The handle is movable in a direction parallel to the longitudinal axes of rods 22, as shown by the arrowheads in FIG. 1, between a retracted position wherein the handle is completely within the frame and an extended position limited by the flaring portion 34 engaging the wall 14.

Figure 4:
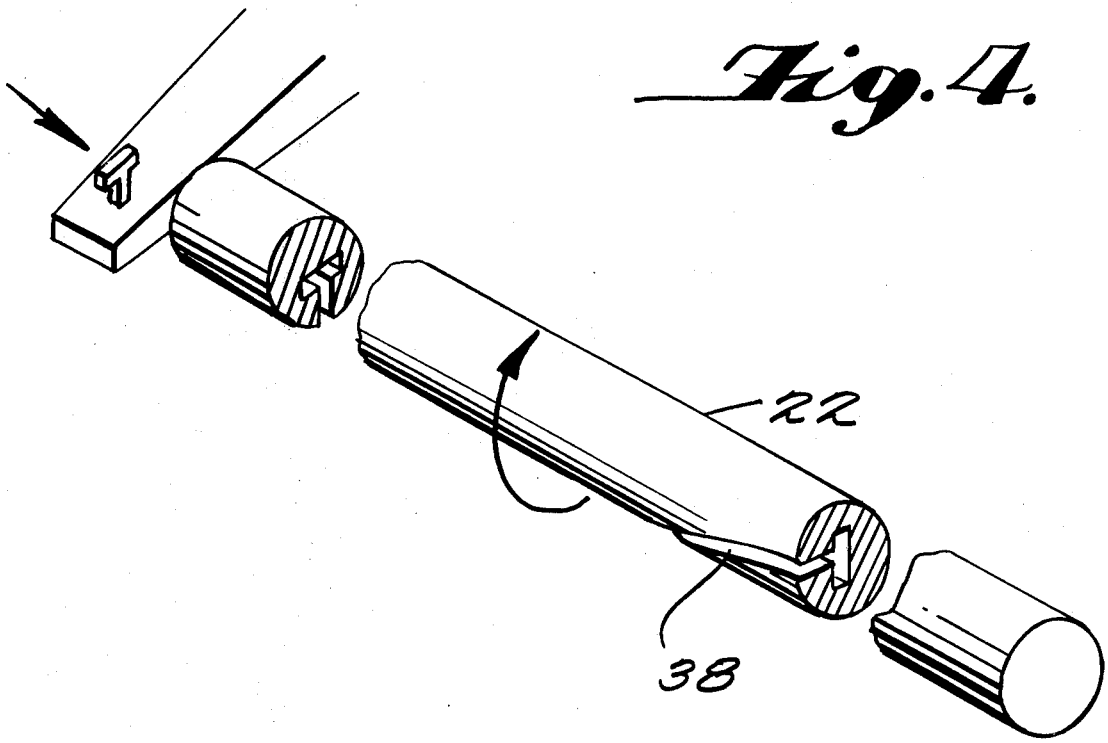
FIG. 4 is a diagrammatic illustration of the relationship between a portion of the handle shown in FIG. 3 and a bristle-supporting rod (the bristles being omitted for convenience of illustration)

As can be appreciated from FIGS. 2, 4 and 5, each of the rods 22 is provided with a groove 38 having a T-shaped cross-section to receive the projections 32 of the handle 28. While a T-shape is employed for the projections 32 of the handle and the cross-section of grooves 38, it will be appreciated that other convenient shapes also may be employed. Each groove 38 extends generally longitudinally of its respective rod for a portion of its distance and then describes a partially helical curve transcribing up tc 90° of the circumference of the rod. Consequently, when the projections 32 are moved within the curved portions of the grooves due to activation of the handle 28, the rods 22 are rotated up to 90°.

As can be seen in FIG. 5, in the preferred embodiment of the invention, the curvature of the grooves 38 commences at different points along the respective rods 22. In the central rod, the curvature begins at a point located closer to wall 12 of the frame 10 than in the case of the remaining rods, the distances to the beginning of curvature increasing for successive rods positioned outwardly of the central rod. Accordingly, with the projections 32 of handle 28 lying in a plane transverse to the longitudinal axes of rods 22, for a given displacement of the projections with respect to the curved grooves in the rods, the latter will be rotated by differing amounts. Thus, if the rows of bristles on the rods are arranged to be in overlapping contacting relationship with bristles of one or more adjacent rods when the handle 28 is fully retracted within the frame, subsequent extension of the handle to a point where the center rod rotates 90° results in its bristles being erected 90° while the remaining bristles are raised by lesser amounts. Consequently, the tips of the bristles define an arc, as indicated by the line designated as 40 in FIG. 1. This bristle arrangement facilitates the brushing of one's hair.

It should be noted that the direction of curvature of the grooves in rods 22 positioned outwardly of the central rod(s) is a symmetrical arrangement. This results in corresponding ones of these rods being rotated in different directions. Thus, when the handle 28 is retracted, approximately half the bristles will collapse in one direction and half in the other.

While such an arrangement as just described with respect to FIGS. 1-5 is preferred, it should also be appreciated that by not staggering the locations along rods 22 where curvature of the grooves 38 begins, actuation of the handle 28 results in the rods rotating by equal amounts. With such an arrangement each of the rows of bristles can be raised 90° so that the planes of the bristles are parallel when they are erected. In this case, there is no arc described by the bristle tips unless the bristles in adjacent rows are of different size and/or the axes of the rods 22 are not in the same plane. By appropriate arrangement of the curvature of the grooves 38 in the rods 22, the bristles also can be collapsed in one direction.

With the brush construction just described, a compact, portable, lightweight and collapsible brush is provided which is economical to produce and which does not include components which are subject to substantial wear.

What is claimed is:

1. A collapsible brush comprising:

a frame;

a plurality of cylindrical rods supported by said frame in a manner such that their longitudinal axes are parallel to one another;

a row of bristles supported by each of said rods;

a groove in each of said rods extending generally longitudinally thereof and including a curved segment;

a handle mounted for movement with respect to said frame, said handle including a plurality of projections extending within respective ones of the grooves whereby when said handle is moved so that the projections engage the curved groove segments, the rods are rotated about their longitudinal axes to move the rows of bristles between collapsed and raised positions.

2. A collapsible brush as set forth in claim 1, wherein said frame includes a pair of spaced walls supporting the ends of said rods.

3. A collapsible brush as set forth in claim 2, wherein said frame further includes spaced bottom portions extending between said walls, the handle being at least partially located in the space between said bottom portions.

4. A collapsible brush as set forth in claim 3, wherein said handle is movable in a direction parallel to the longitudinal axes of said rods.

5. A collapsible brush as set forth in claim 4, wherein movement of the handle with respect to the frame is limited by engagement of the handle with said walls.

6. A collapsible brush as set forth in claim 2, wherein the curved groove segments in rods located on one side of the center of said frame commence at different distances from the walls of said frame.

7. A collapsible brush as set forth in claim 2, wherein the grooves in rods located on one side of the center of said frame are symmetrical with respect to the grooves in corresponding rods located on the opposite side of the center of the frame.

8. A collapsible brush as set forth in claim 7, wherein the curved groove segments in rods located on either side of the center of said frame commence at different distances from the walls of said frame.

9. A collapsible brush comprising:

a frame having a pair of spaced walls and a pair of spaced bottom portions extending between said walls;

a plurality of cylindrical rods supported at their ends by said walls in a manner such that their longitudinal axes are parallel to one another;

a row of bristles supported by each of said rods;

a groove in each of said rods extending generally longitudinally thereof and including a curved segment;

a handle partially located in the space between said bottom portions and including handle portions resting on said bottom portions, said handle being adapted for movement with respect to the frame in a direction parallel to the longitudinal axes of said rods, said handle further including a plurality of projections extending within respective ones of the grooves whereby when said handle is moved so that the projections engage the curved groove segments, the rods are rotated about their longitudinal axes to move the rows of bristles between collapsed and raised positions.

10. A collapsible brush as set forth in claim 9, wherein movement of the handle with respect to the frame is limited by engagement of the handle with the walls.

11. A collapsible brush as set forth in claim 9, wherein the curved groove segments in rods located on one side of the center of said frame commence at different distances from the walls of said frame.

12. A collapsible brush as set forth in claim 9, wherein the grooves in rods located on one side of the center of said frame are symmetrical with respect to the grooves in corresponding rods located on the opposite side of the center of the frame.

13. A collapsible brush as set forth in claim 12, wherein the curved groove segments in rods located on either side of the center of said commence at different distances from the walls of said frame.

14. A collapsible brush as set forth in claim 13, wherein movement of the handle with respect to the frame is limited by engagement of the handle with the walls.

* * * * *